United States Patent [19]

Dutfield

[11] 4,393,767

[45] Jul. 19, 1983

[54] VERTICAL REFUSE COMPACTOR

[75] Inventor: James H. Dutfield, Palgrave, Canada

[73] Assignee: Reftech Limited, Woodbridge, Canada

[21] Appl. No.: 297,196

[22] Filed: Aug. 28, 1981

[30] Foreign Application Priority Data

Aug. 11, 1981 [CA] Canada ..... 383644

[51] Int. Cl.[3] ..... B30B 15/30

[52] U.S. Cl. ..... 100/229 A; 100/295

[58] Field of Search ..... 100/229 A, 229 R, 240, 100/295; 312/312

[56] References Cited

U.S. PATENT DOCUMENTS

| | | | |
|---|---|---|---|
| 206,658 | 8/1878 | Blossom | 100/295 |
| 886,192 | 4/1908 | DeCanio | 312/312 |
| 3,853,052 | 12/1974 | Engebretsen | 100/229 A |
| 3,991,670 | 11/1976 | Stromberg | 100/295 |
| 4,009,838 | 3/1977 | Tashman | 100/229 A |
| 4,156,386 | 5/1979 | Gould | 100/229 A |
| 4,235,165 | 11/1980 | Fenner et al. | 100/229 A |

FOREIGN PATENT DOCUMENTS 2037653 7/1980 United Kingdom ..... 100/295

OTHER PUBLICATIONS

Brochure-Marathon Equipment Co. "Vert-I-Pack", Apr., 1981.

*Primary Examiner*—Billy J. Wilhite

*Attorney, Agent, or Firm*—Moss, Bensette, Thompson, Squires

[57] ABSTRACT

The invention discloses a refuse compactor assembly for compacting refuse into a cubical open-topped refuse receptacle having an enclosure structure for slidably receiving the cubical refuse receptacle and retaining same within the compactor assembly by force of gravity alone by providing a downwardly rearwardly inclined refuse receptacle support surface in the interior of the refuse compactor assembly. The refuse placed into the refuse receptacle is compacted by a reciprocably operable ram member which is provided with a wedge like compactor surface in the shape of a prism or, alternatively, an inverted pyramid.

16 Claims, 7 Drawing Figures

VERTICAL REFUSE COMPACTOR

BACKGROUND OF THE INVENTION

1. Field of the Invention

This invention relates generally to a refuse compacting assembly and more particularly to a refuse compacting assembly adapted to compact refuse into open topped cubicle refuse receptacles.

2. Description of the Prior Art

In the past, refuse receptacles having a generally cubicle structure have been provided at sites or locations where a large volume of solid refuse was produced, as for example apartment blocks, construction sites, stores, warehouses, etc. These refuse receptacles had normally been filled by merely tossing the refuse into the receptacle and emptying same when the receptacle became full. However, this manner of allowing the refuse to accumulate in a loose fashion in the receptacle causes the receptacle to become full with refuse very quickly thereby necessitating frequent attendance at the receptacle by a disposal truck into which the receptacle could be emptied.

More recently, horizontal packing refuse receptacles have been designed for use with or to be part of horizontal compacting assemblies which periodically densify the refuse which is placed into the horizontal packing receptacle by employing a horizontal extendible compaction ram. Densifying the refuse was found to allow more refuse to be accumulated within a receptacle before it became full. Refuse compaction therefore has the advantage or reducing the number of attendances required at the receptacle by a disposal truck for the purpose of emptying the receptacle.

It has been found that horizontally packing refuse receptacles tend to leak any fluid refuse which may be placed into the refuse receptacle. This leakage of fluid refuse causes potential health hazards in the area provided for the compacting assemblies as the fluid refuse accumulates around the compacting assembly. To reduce the potential health hazard with this type of compacting assembly it is necessary to frequently wash the area around the compacting assembly. Moreover, these horizontally operable compacting assemblies have been found to be inconvenient to empty since they require the operator of the disposal truck to dismount the truck to disconnect or disengage the receptacle from the compactor assembly.

The disconnection process entails, in some cases, disconnecting hydraulic hoses attached to the receptacle which hoses were used to operate the hydraulic compaction ram provided in the refuse receptacle itself. In other cases, the receptacle was retained within the compacting means by various latches, doors and/or bolts which had to be manually undone to enable the receptacle to be removed from the compaction assembly. These latches, doors or bolts were provided to secure the refuse receptacle within the compactor assembly to ensure that the refuse receptacle was always properly aligned with respect to the compactor ram located in the compactor assembly. During the compaction cycle, the refuse receptacle had a tendency to move around inside the compactor assembly, such that it became improperly aligned with respect to the compactor ram. This penomenon is referred to as walking out. Ultimately, where the refuse receptacle was not securely retained by latches, doors, bolts or the like, the refuse receptacle could walk out of the compactor assembly to such an extent that it would be crushed or deformed in a suceeding compaction cycle.

A further disadvantage of the prior art compactors was the tendency of the compactor ram to compress only that refuse located directly below the ram surface. Suitable uniform compaction of all refuse within the refuse receptacle could be obtained by providing a compactor ram surface which covered substantially all of the refuse contained within the receptacle during a compaction cycle. However, providing such a large compaction surface is relatively expensive because of the necessity of providing a strong, rigid support structure behind the compactor surface to prevent it from bending and otherwise deforming when the refuse was being compacted.

SUMMARY OF THE INVENTION

Accordingly, it is an object of the present invention to at least partially overcome these disadvantages by providing a refuse compactor assembly which enables an open-topped refuse receptacle to be installed in and removed from a refuse compactor assembly quickly and easily by eliminating the need or requirement of having the refuse receptacle hydraulically connected to or physically latched to the refuse compactor assembly.

It is a further object of this invention to provide a refuse compactor which slidably receives a refuse receptacle and retains same within the compacting assembly by force of gravity alone.

Yet another object of the present invention is to provide a refuse compactor assembly which does not leak liquid refuse by permitting compaction of refuse into an open-topped refuse receptacle.

To this end, in one of its aspects, the invention provides a compactor for compacting material in an open topped receptacle comprising a receptacle support surface which is inclined from a high end to a low end; means for retaining a receptacle on the support surface, the retaining means preventing horizontal movement of the receptacle in any horizontal direction except in a direction up the inclined surface towards the high end; and a compactor device supported above the support surface with a space for the receptacle being provided beneath the device, the compactor device including a ram member mounted for reciprocal, vertical movement into and out of a receptacle arranged on the support surface, wherein the compactor has an access at the high end for placement of the receptacle into the space below the assembly and removal of the receptacle after the receptacle has been filled.

In the preferred embodiment the compactor ram provides a substantially uniformly compacted refuse within a refuse receptacle yet requires a ram surface having an area less than the surface area of the refuse which is to be compacted.

A preferred embodiment of the invention will now be described, by way of example, with reference to the accompanying drawings, in which:

DETAILED DESCRIPTION OF THE PREFERRED EMBODIMENT

Figure 1:
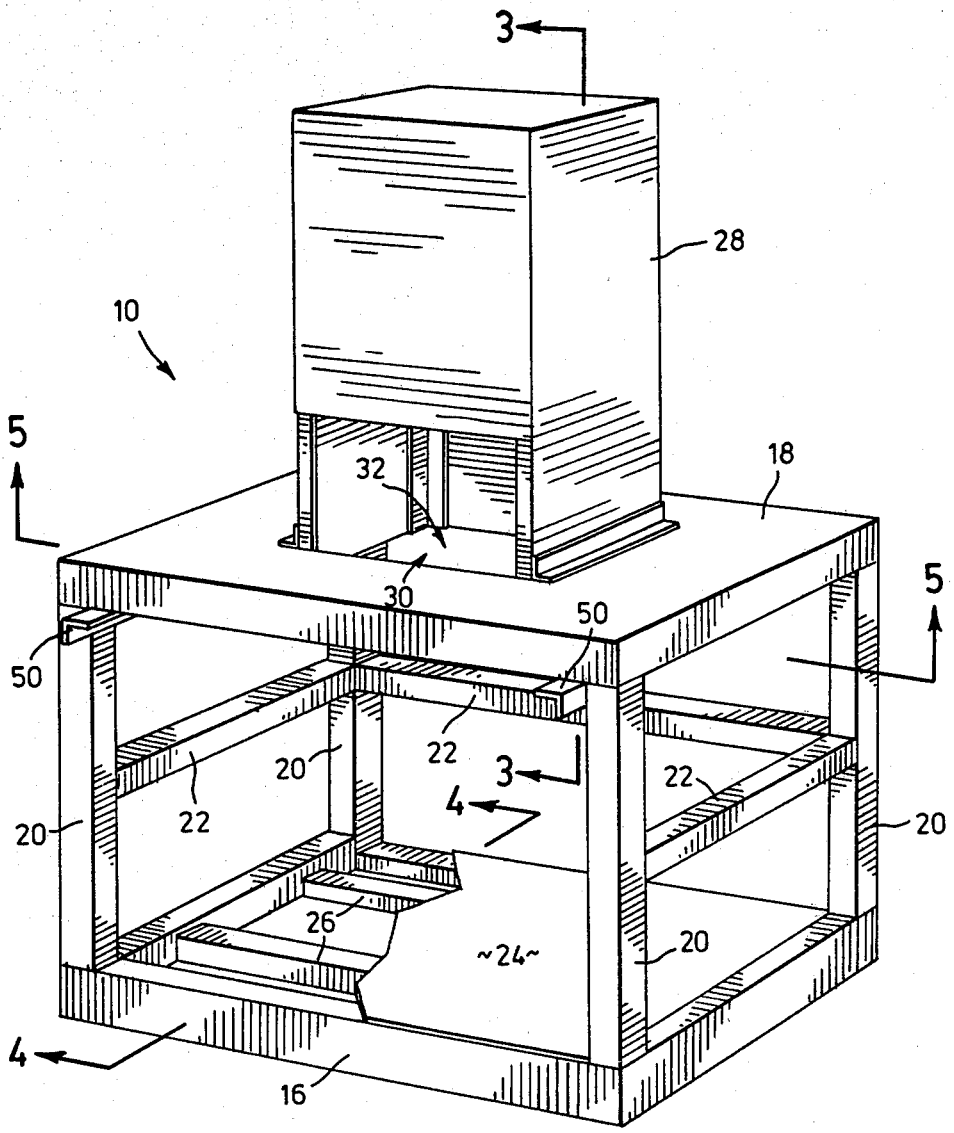
FIG. 1 is a frontal upper perspective view of the preferred embodiment of the refuse compactor in accordance with the present invention.

Reference is first made to FIG. 1 which shows a preferred embodiment of the refuse compactor in accordance with the present invention designated generally by reference numeral 10.

Shown at the lower portion of the refuse compactor 10 is an enclosure structure designated generally by reference numeral 12. The enclosure structure 12 provides a structure for retaining the prior art open topped refuse receptacle shown in FIG. 2. The enclosure structure 12 is a substantially rectangular structure having a bottom side 16 and a coextensive top side 18, both of which are connected together by four rigid post structures 20. Interconnecting these rigid post structures 20 on three sides of the substantially cubicle enclosure structure 12 are shown interconnecting members 22 which are provided to retain the open topped refuse receptacle within the interior of the enclosure structure 12, and to enhance the strength of the enclosure structure itself.

As may be appreciated, the enclosure structure may be constructed of any rigid material, as for example steel or the like. In the preferred embodiment, square tubular construction iron is used along with angle iron and plates, etc. to assemble the enclosure structure and indeed many elements of the refuse compactor in accordance with the principles of steel fabrication.

Figure 4:
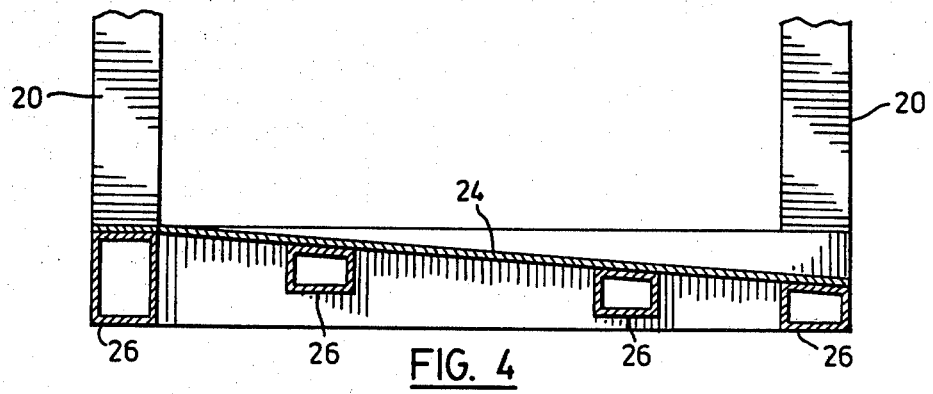
FIG. 4 is a cross-sectional view along line 4—4 of the lower portion of the preferred embodiment of the refuse compactor shown in FIG. 1.
Figure 5:
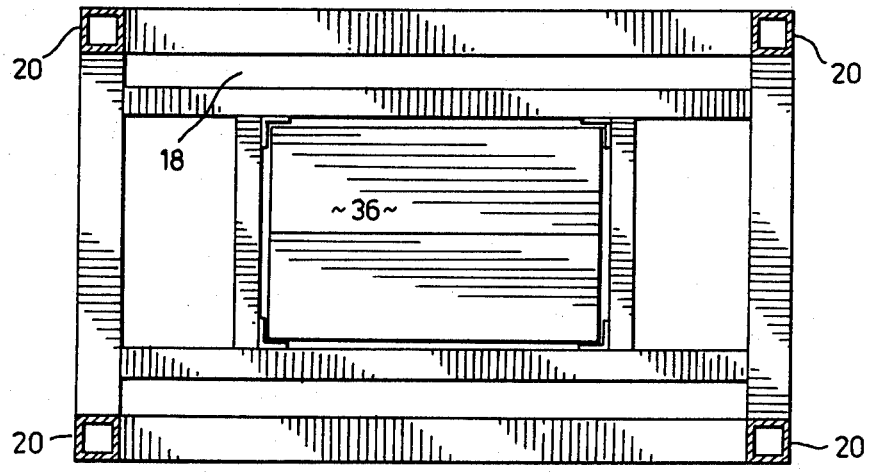
FIG. 5 is a bottom cross-sectional view of the preferred embodiment of the refuse compactor taken along line 5—5 of FIG. 1.

Provided along the bottom surface of enclosure structure 12 is shown a receptacle support surface 24, the construction of which can be appreciated more readily from the cross-sectional diagram thereof given in FIG. 4.

Turning now to FIG. 4, it may be seen that receptacle support surface is constructed such that it has a downwardly rearwardly inclined surface 24. Secured underneath receptacle support surface 24 are a number of reinforcing beams 26 which are used to increase the strength of the receptacle support surface 24 when forces substantially normal to the support surface 24 are bearing down thereupon. As will be appreciated from subsequent discussions, receptacle support surface 24 must be strong enough to withstand substantial forces normal thereto when the refuse compactor is in use, particularly during the compaction cycle of operation when refuse within the refuse receptacle is being compacted by ram member 36.

Referring now to FIG. 1, disposed above the enclosure structure 12 is shown a compactor assembly 28 which is provided with a refuse receiving opening shown generally by reference numeral 30. The refuse receiving opening 30 communicates with the interior of the enclosure structure 12 via opening 32 which is provided in the top side 18 of the enclosure structure. Accordingly, any refuse which is directed toward refuse receiving opening 30 will be caused, by force of gravity, to fall into the interior of enclosure structure 12 by passing through the opening 32.

Figure 3:
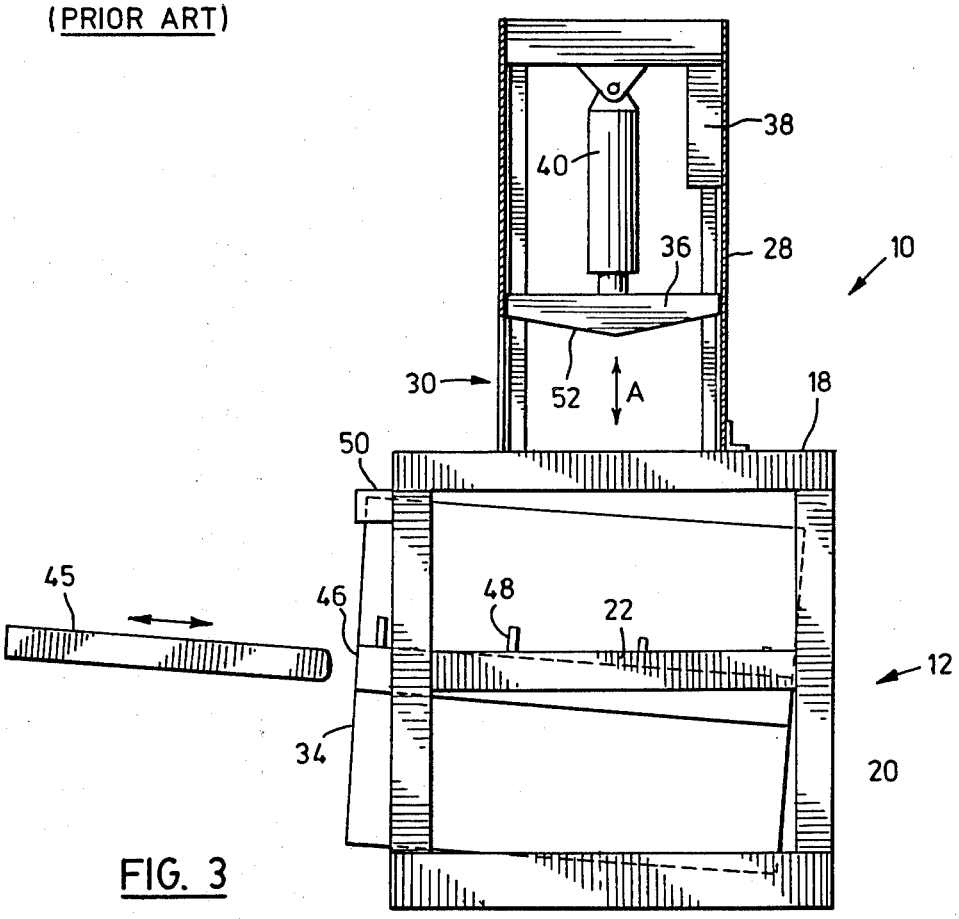
FIG. 3 is a side plan view showing, in partial cross section along line 3—3 of FIG. 1, the preferred embodiment of the refuse compactor retaining the open topped refuse receptacle of FIG. 2.

By reference to FIG. 3, it can be appreciated that refuse placed into refuse receiving opening 30 will pass into the interior of the enclosure structure 12 thereby to be received into the open topped surface receptacle 34 shown disposed within the interior of the enclosure structure 12.

Once a number of articles of refuse have been directed into the open topped refuse receptacle 34 in the manner described above, it will be appreciated that the refuse will tend to fill up the open topped refuse receptacle 34 thereby preventing the introduction of further refuse into the refuse receptacle 34. By compressing the refuse within the refuse receptacle 34, it will be appreciated that further refuse may be introduced into the receptacle without the need or requirement of removing the refuse receptacle from the enclosure structure 12 for emptying.

To permit compression or densification of the refuse within the refuse receptacle 34, the compactor assembly 28 is provided with a ram member 36 which is reciprocably operable within the compactor assembly 28 and into and out of the interior of the enclosure structure 12. The direction of movement of the ram member 36 is shown generally by double headed arrow A. In one direction of operation, ram member 36 slides down along compactor assembly 28 through the opening 32 in the top side of the enclosure 18 and into the interior of the open topped refuse receptacle 34 which is disposed within the interior of the enclosure structure 12. Upon completion of the compression stroke as aforesaid, the direction of movement of ram member 36 is reversed such that it retreats upwardly out of the open topped refuse receptacle 34 and back into the compactor assembly 28 to rest in the position shown in FIG. 3. To operate the ram member 36, the compactor assembly 28 is provided, in the preferred embodiment, with an hydraulic cylinder 40 which is provided with an hydraulic controller and hydraulic power source 38 in accordance with the principles of hydraulic machines.

Figure 2:
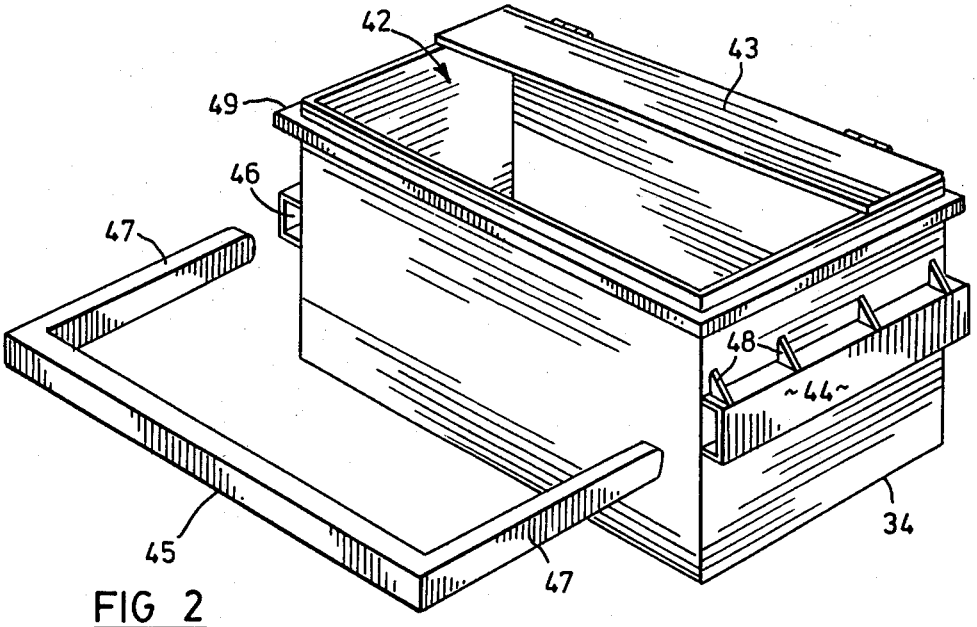
FIG 2 (PRIOR ART)
FIG. 2 is an upper perspective view of a prior art open topped refuse receptacle.

Turning now to FIG. 2, a description of the prior art open topped refuse receptacle 34 and its manner of handling will now be described. The open topped refuse receptacle 34 is provided with a top opening 42 into which refuse and debris may be placed. The top opening 42 may be partially enclosed by a hinged lid 43. Also, in some open topped refuse receptacles, an outer perimeter reinforcing member 49 is added to give structural strength to the refuse receptacle. At each end of the receptacle 34 may be seen a structure which permits handling of the open topped refuse receptacle. This structure consists of a pair of square tubular members 44 which form a pair of pockets 46 into which an articulated lifting fork 45, having two parallel tines 47 spacedly disposed and adapted to enter both pockets 46 simutaneously, may be placed. The articulated fork as aforesaid is attached to a disposal truck (not shown) and is operable to pick up the refuse receptacle 34 to carry it toward a haulage container provided on the truck and cause the refuse receptacle 34 to be inverted or turned upside down to be emptied into the haulage container of the truck. The controls which operate the articulated fork 45 of the garbage disposal truck which empties the open topped refuse receptacle in the manner described above are normally found within the cab where the operator of the truck is seated.

Typically, the refuse in a receptacle such as this will weigh upwards of 2,400 lbs. Therefore, to strengthen the pockets 46, gussets 48 are provided along the length of the square tubular member 44. Moreover, reinforcing plates (not shown) may be provided on the exterior of the receptacle to which the gussets 48 and square tubular member 44 may be securely attached; thereby reinforcing the receptacle walls.

Referring now to FIG. 3, the ease of emptying the open topped refuse receptacle 34 disposed within the refuse compactor 10 in accordance with the present invention will now be explained. The operator of the garbage disposal truck will attend with the truck at the refuse compactor for the purpose of emptying the open topped refuse receptacle 34. The pockets 46 of the refuse receptacle are accessible by the articulated fork 45 of the disposal truck since the pockets project outwardly from the interior of the enclosure structure 12 through the front opening thereof. The operator of the garbage disposal truck can direct the articulated fork 45 into the pockets 46 and cause the filled refuse receptacle 34 to be drawn upwardly and outwardly from the interior of the enclosure structure 12. No attachments of any kind are made between the refuse compactor 10 and the open topped refuse receptacle 34.

Once the open topped refuse receptacle has been emptied into the garbage disposal truck, the operator thereof may re-position the open topped refuse receptacle 34 in front of the enclosure structure 12 and re-insert the receptacle 34 into the interior of the enclosure structure 12 by sliding same along the receptacle support surface 24 downwardly, inwardly into the interior of the enclosure structure 12.

To enable the operator of the garbage disposal truck to position the open topped refuse receptacle 34 properly in front of the opening of the enclosure structure 12, the said opening is provided with means for guiding the open topped receptacle 34 into the interior of the enclosure structure 12. In the preferred embodiment, these means comprise a pair of protrusions 50 at the upper corners of the opening of the enclosure structure 12. Once the open topped refuse receptacle 34 has been properly positioned below these protrusions 50, the receptacle can be directed downwardly and inwardly into the interior of the enclosure structure 12 to rest in the fashion shown in FIG. 3.

The downward inclination of the refuse receptacle 34 within the enclosure structure 12 is maintained by the inclined support surface 24. As may be appreciated, the force of gravity on the refuse receptacle 34 will cause same to be drawn downwardly and inwardly into the interior of the enclosure structure 12. However, the refuse receptacle 34 is prevented from sliding out of the enclosure structure 12 by receptacle retaining means which, in the preferred embodiment, are provided by the interconnecting members 22. Thus the refuse receptacle 34 is held properly positioned in the refuse compactor 10 yet is quickly and easily removable from the refuse compactor without the need or requirement to undo latches, hoses or other securing mechanisms. Yet a compactor assembly in accordance with the present invention prevents the refuse receptacle from "walking out" of the compactor by force of gravity operating on the refuse receptacle 34 drawing same downwardly and inwardly into the enclosure structure along receptacle support suface 24. The cross members 22 of the enclosure structure keep the refuse receptacle aligned under ram member 36 during successive compaction cycles.

The downwardly rearwardly inclined support surface 24 must have a sufficient inclination to maintain the refuse receptacle 34 within the interior of the enclosure structure 12 during the successive compaction cycles of the ram member 36 (i.e. prevent "walking out"), yet, the inclination must not be so great that the refuse receptacle 34 will be deformed during the compaction cycle of the ram member 36. It has been found that, preferably, an inclination of the support surface 24 of a gradient of 2 percent achieves the best balance between these two competing considerations. However, a gradient anywhere between 1 percent to 10 percent may also be used satisfactorily.

Figure 6:
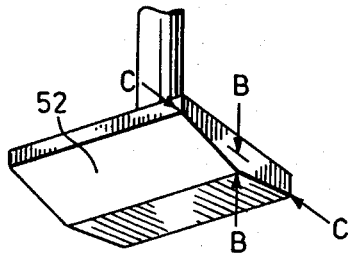
FIG. 6 is a lower frontal perspective view of a ram member in accordance with the preferred embodiment of the refuse compactor.
Figure 7:
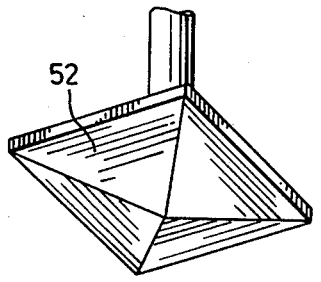
FIG. 7 is an alternate embodiment of the ram member which may be provided in the refuse compactor.

To permit reduction in size of the compactor surface 52 of the ram member 36 to an area not greater than one half of the surface area of the open top of the open topped refuse receptacle 34 while still obtaining a uniform densification of the refuse within receptacle 34 during the compaction cycle, the surface 52 of the ram member 36 is provided with a wedge-like shape. Alternate embodiments of this wedge-like shape are shown in FIG. 6 and FIG. 7. In FIG. 6, a triangular prism surface is shown. The height of the prism is the distance between the arrows labelled B and the width of the prism is the distance between the arrows labelled C. Optimum uniform densification is achieved by a ram member having this surface shape when the ratio between the height (the distance between the arrows labelled B) and the width (the distance between the arrows labelled C) is approximately 5 percent. However, other values of height to base width ratios between 5 to 20 percent may be used with acceptable performance.

Referring now to FIG. 7, an alternate configuration of the ram surface 52 is shown. It takes the form of a pyramidal surface having a height to base length ratio of between 5 percent and 20 percent.

Although particular embodiments of the invention have been illustrated in the drawings and described in the foregoing description, it will be understood that the invention is not limited to the embodiments disclosed, but is capable of numerous re-arrangements, modifications, and substitutions of parts and elements without departing from the spirit of the invention as defined in the claims appended hereto.

What I claim as my invention is:

1. A compactor for compacting material in an open topped receptacle comprising:

an enclosure structure including a bottom side, a coextensive top side and rigid vertical post structures extending between and connecting said bottom and top sides, the top side having an opening for passing refuse material therethrough;

said bottom side including a receptacle support surface which is inclined from a high front end to a low rear end;

the enclosure structure defining a front opening for passing a receptacle therethrough;

means for retaining a receptacle on said support surface, said retaining means preventing horizontal movement of said receptacle in any horizontal direction except in a direction up said inclined surface out of said front opening; and a compactor device mounted on the top side over said top side opening, said compactor device including a ram member mounted for reciprocal, vertical movement into and out of a receptacle arranged on said support surface, said compactor device having a refuse receiving opening located below the ram for passing refuse therethrough and through the top side opening into a receptacle.

2. A compactor according to claim 1 wherein said ram member has a bottom compactor surface which is divided along a centre line, said surface being inclined upwardly from said centre line on both sides of said line.

3. A compactor according to claim 2 wherein said bottom compactor surface has an area not greater than one-half the area of the opening in the top of the receptacle to be used.

4. A compactor according to claim 1, 2 or 3 wherein the gradient of the support surface is between 1% and 10%.

5. A compactor according to claim 1, 2 or 3 wherein the gradient of the support surface is about 2%.

6. A compactor according to claim 1, 2 or 3 wherein said retaining means comprises an enclosure structure including an upper horizontal frame, a lower horizontal frame on which said support surface is provided, rigid, vertical frame members extending between and connecting said upper and lower frames, and further frame members extending between said vertical frame members.

7. A compactor according to claim 6 wherein said compactor device is mounted on top of and supported by said upper horizontal frame.

8. A compactor according to claim 1, 2 or 3 wherein said support surface is substantially square and said compactor device is positioned above the centre of said support surface.

9. A compactor according to claim 1 wherein the bottom surface of said ram member has an inverted pyramidal shape and an area not greater than one-half the area of the open top of the receptacle to be used.

10. A refuse compactor comprising:

a substantially cubical enclosure structure, having a top side and a substantially coextensive bottom side, rigid interconnecting members extending therebetween, and receptacle retaining means attached to the enclosure structure, said enclosure structure provided with a frontal opening for slidably receiving an open topped refuse receptacle into the interior thereof, a downwardly rearwardly inclined receptacle support surface disposed along the interior of the bottom side of the enclosure structure, and a compactor assembly attached to the exterior of the top side of the enclosure structure and defining a refuse receiving opening in communication with the interior of the enclosure structure, said assembly including a ram member slidably disposed within the compactor assembly and reciprocably operable into and out of the interior of the enclosure structure.

11. A refuse compactor as recited in claim 10 wherein the gradient of the downwardly rearwardly inclined receptacle support surface is between 1% to 10%.

12. A refuse compactor as recited in claim 10 wherein the gradient of the support surface is about 2%.

13. A refuse compactor as recited in claim 11 wherein the frontal opening is rectangular and wherein the enclosure structure further includes means for guiding an open topped refuse receptacle, into the interior of the enclosure structure.

14. A refuse compactor as recited in claim 13 wherein the means for guiding the open topped refuse receptacle comprises:

a pair of protrusions, each disposed at a respective upper corner of the rectangular frontal opening of the enclosure structure.

15. A refuse compactor as recited in claim 10, 11 or 13 wherein the bottom end of the ram member defines a triangular prism surface having a height to base width ratio between the values of 5% to 20%, which surface has an area not greater than one-half the area of the opening in the open topped receptacle.

16. A refuse compactor as claimed in claim 10 or 11 wherein the bottom end of the ram member defines an inverted pyramidal surface having a height to base length ratio between the values of 5% to 20%, which surface has an area not greater than one-half the area of the opening in the open topped receptacle.

* * * * *